US006176377B1

(12) United States Patent
Ali et al.

(10) Patent No.: US 6,176,377 B1
(45) Date of Patent: Jan. 23, 2001

(54) RACK FOR SUPPORTING ABRASIVE DISCS OR THE LIKE

(75) Inventors: Terry Ali; Christopher Ali; Phillip Glenn Ali, all of Fairborn, OH (US)

(73) Assignee: Ali Industries, Inc., Fairborn, OH (US)

( * ) Notice: Under 35 U.S.C. 154(b), the term of this patent shall be extended for 0 days.

(21) Appl. No.: 09/376,948

(22) Filed: Aug. 18, 1999

(51) Int. Cl.[7] ..... A47G 19/08
(52) U.S. Cl. ..... 211/41.1; 211/41.18; 206/711
(58) Field of Search ..... 211/41.1, 70.6, 211/45, 50, 41.12, 41.18, 88.01, 90.01; 206/454, 710–712

(56) References Cited

U.S. PATENT DOCUMENTS

D. 147,237 * 8/1947 Herzog ..... 211/70.6
D. 162,926 * 4/1951 Berkowitz ..... 211/70.6
D. 180,106 * 4/1957 Seifert ..... 211/70.6
3,610,613 * 10/1971 Worden ..... 211/41.18
3,826,377 * 7/1974 Bachmann ..... 211/41.18
3,991,884 * 11/1976 DeMaagd et al. ..... 211/45
4,256,229 * 3/1981 Lee ..... 206/710
4,505,393 * 3/1985 Fleigle et al. ..... 211/41.1
4,572,101 * 2/1986 Lee ..... 211/41.18
4,762,689 * 8/1988 Frey et al. ..... 211/45
4,993,559 * 2/1991 Cota ..... 211/41.18
5,027,956 * 7/1991 Lotufo ..... 211/45
5,307,941 * 5/1994 Siegal ..... 211/45 X
5,421,466 * 6/1995 Hsu ..... 211/45 X
5,490,011 * 2/1996 Pernick et al. ..... 211/41.1
5,598,924 * 2/1997 McCann ..... 211/70.6
5,607,065 * 3/1997 Todd ..... 211/41.12
5,657,879 * 8/1997 Anderson et al. ..... 211/41.18
5,788,304 * 8/1998 Korn et al. ..... 211/41.1

* cited by examiner

*Primary Examiner*—Daniel P. Stodola
*Assistant Examiner*—Jennifer E. Novosad
(74) *Attorney, Agent, or Firm*—R. William Graham

(57) ABSTRACT

A rack for supporting at least one abrasive generally circular disc on a conventional display stand, wherein each disc has two faces and a continuous edge includes a pair of rack support rails which co-extend alongside one another in a spaced relation of a distance less than a diameter of the disc and at least one of the rails includes a raised ridge surface. When the disc is disposed such that its edge contacts the rails and the disc is supported by the rails, the disc is positionably retained by the ridge along a predetermined area of the rail.

7 Claims, 2 Drawing Sheets

RACK FOR SUPPORTING ABRASIVE DISCS OR THE LIKE

BACKGROUND OF THE INVENTION

1. Field of the Invention

The present invention relates generally to the field of display racks. More particularly, but not by way of limitation, the invention relates to a rack for supporting abrasive discs or the like on a conventional display stand.

2. Related Art

There exist a number of display stands for displaying abrasive discs, wheels, paper and the like. Most commonly, these goods are placed flat on a shelf in a stacked manner and slidably removed from the shelf. Another common method of displaying such goods is to attached the goods within a packaging material having a tab portion with an eyelet therein such that the goods hang on a peg board type stand.

Some of these goods, e.g., abrasive discs, are heavy and are relatively limited in number of units which can be horizontally displayed on a peg board type stand. Such goods can be stacked in large numbers on a shelf in a flat manner, this is not as preferred since the goods are not as easily viewed by the customer. Peg board type displays typically use a packaging to hold the goods, which adds further cost to product. Accordingly, there is a need to provide an improved device for displaying such goods. In addition, it is desirable to provide a rack which improved aesthetic qualities for displaying such goods.

BRIEF SUMMARY OF THE INVENTION

It is an object to improve display racks.

It is another object to improve racks which display abrasive discs.

It is yet another object to provide a rack with improved functional and aesthetic characteristics.

Accordingly, the present invention is directed to a rack for supporting at least one abrasive generally circular disc on a conventional display stand. Each disc has two faces and a continuous edge. The rack includes a pair of rack support rails which co-extend alongside one another in a spaced relation, preferably parallel, of a distance less than a diameter of the disc.

At least one of the rails, and preferably both, includes a raised ridge surface. When the disc is disposed such that its edge contacts the rails and the disc is supported by the rails, the disc is positionably retained by the ridge along a predetermined area of the rail.

The rack further includes a front piece interconnecting a front end of each rail and a back piece interconnecting a back end of each said rail. A bottom piece is connected to said rack in a manner to extend below the rails a distance approximate a distance formed between a bottom of the rails and a lowermost point of the edge of the disc when seated on the rails such that the bottom piece further aids in supporting said disc. The rack bottom piece includes a raised ridge surface such that the disc is positionably retained by the raised ridge surface of the bottom piece along a predetermined area of the bottom piece.

Other objects and advantages will be readily apparent to those skilled in the art upon viewing the drawings and reading the detailed description hereafter.

DETAILED DESCRIPTION OF THE INVENTION

Figure 1:
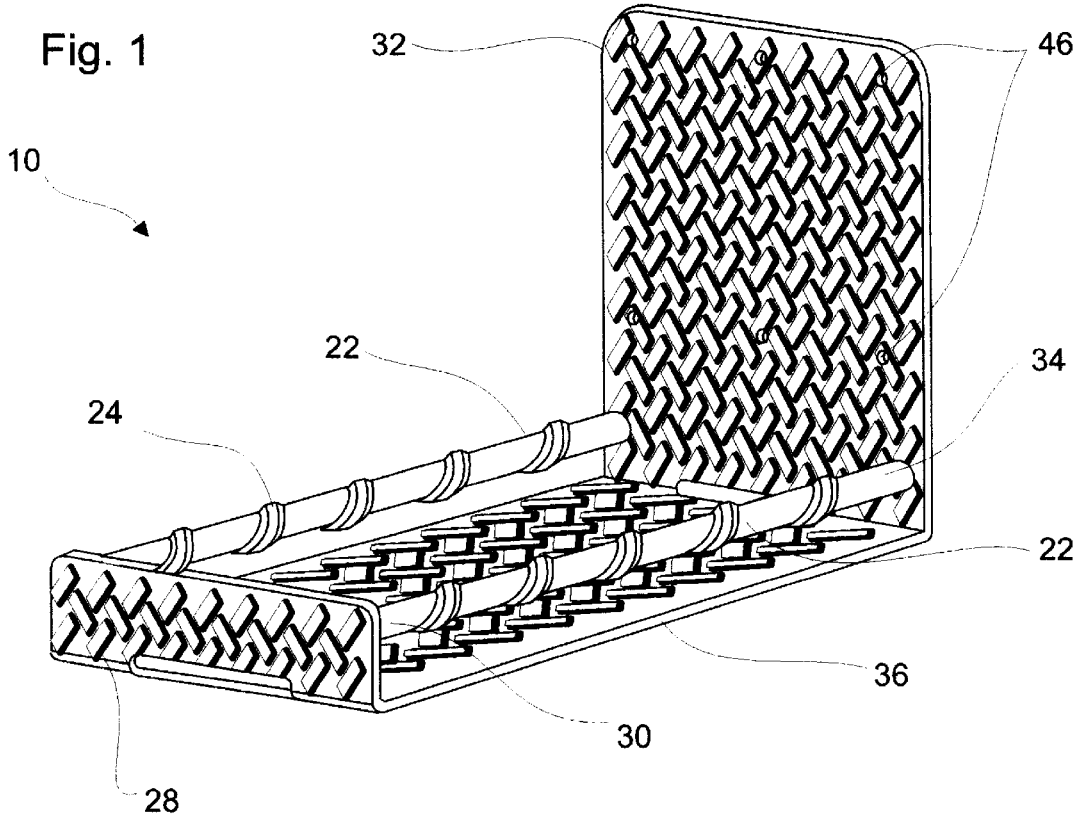
FIG. 1 is a perspective view of the present invention.
Figure 3:
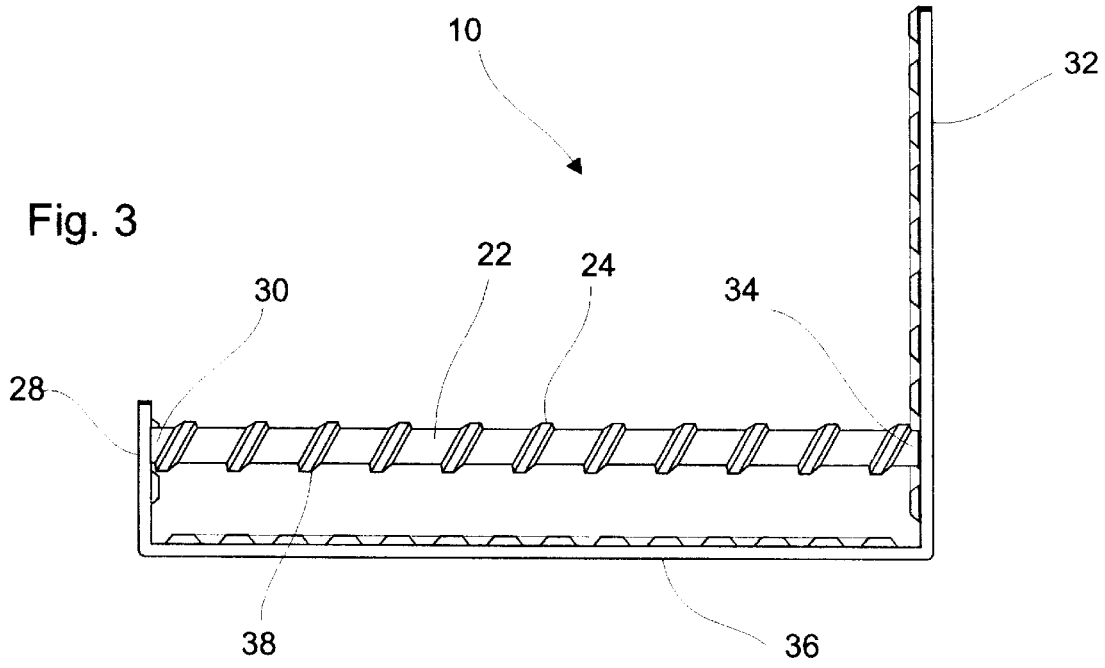
FIG. 3 is a side view of the present invention.
Figure 2:
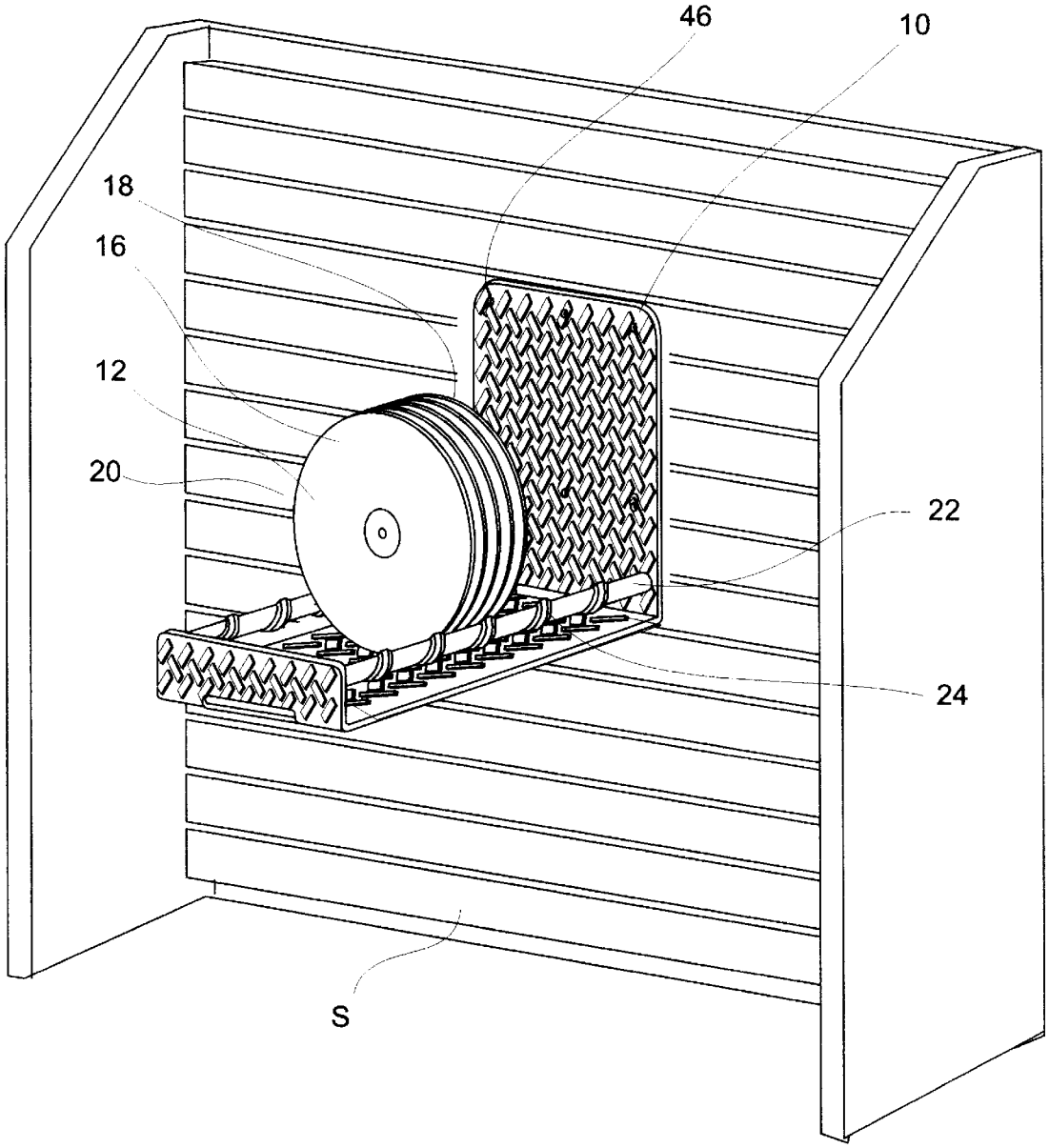
FIG. 2 is another perspective view of the present invention in use.

Referring now to the drawings, the rack of present invention is generally designated by the numeral 10. The rack 10 is particularly useful for supporting at least one abrasive cutting disc 12, and preferably several, which is displayed on a conventional display stand 14 using the rack 10. The discs 12 are generally circular and each has two faces 16 and 18 and a continuous edge 20.

The rack 10 includes a pair of rack support rails 22 which co-extend alongside one another in a parallel spaced relation of a distance less than a diameter D of the disc 12. The rails 22 include a raised ridge surface 24. When the disc 12 is disposed with its edge 20 contacting the rails 22 such that the disc 12 is supported by said rails, the disc is positionably retained by the raised ridge surface 24 along a predetermined area 26 of said rails 22. Each rail 22 has the raised ridge surface 24 generally longitudinally positioned in a spiral manner about each rail 22. As shown here, the rails 22 are made from a piece or rebar. However, it is contemplated by the inventor that other configurations can be employed to carry out the invention.

The rack 10 further includes a front piece 28 interconnecting a front end 30 of each rail 22, and a back piece 32 interconnecting a back end 34 of each rail 22. A bottom piece 36 interconnects the front piece 28 and the back piece 32 of the rack 10. The front piece 28, back piece 32 and bottom piece 36 are preferably integrally formed in a U-shaped manner out of diamond stamped floor.

The bottom piece 36 extends below the rails 22 a distance approximate a distance formed between a bottom 38 of the rails 22 and a lowermost point 40 of the edge 20 of the disc 12 when seated on the rails 22 such that the bottom piece 36 further aids in supporting the disc 12.

The bottom piece 36 includes a raised ridged surface 42 such that the disc 12 is positionably retained by the raised ridged surface 42 along a predetermined area 44 of the bottom piece 36.

The rack 10 includes means 46 for connecting the back piece 32 to the display stand S. The connecting means 46 includes eyelets formed in the back piece 32 of the rack 10 The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A rack for supporting at least one abrasive generally circular disc on a display stand, which includes:

A) a front piece;

B) a back piece;

C) a bottom piece, a first end of which is connected to said front piece and a second end of which is connected to said back piece to form a generally U-shaped structure, said front piece, said back piece and said bottom piece having substantially the same width, said bottom piece exhibiting a plurality of raised edges extending transversely across said bottom piece;

D) a pair of rack support rails connected to said front piece and to said back piece, said pair of rack support rails co-extending alongside one another in a spaced parallel relation, wherein at least one of said rails includes a raised continuous spiral ridge surface thereon; and E) means for connecting said rack to the display stand.

2. The rack of claim 1, which is further characterized such that each rail has a raised ridge surface.

3. The rack of claim 2, wherein each raised ridge surface is generally longitudinally positioned in a corresponding manner along said rail.

4. The rack of claim 3, wherein each rail is a piece of rebar.

5. The rack of claim 1, wherein said at least one of said rails is a piece of rebar.

6. The rack of claim 1 wherein said front piece, said back piece and said bottom piece are homogeneously formed in a generally U-shaped manner.

7. A display rack in combination with at least one abrasive generally circular disc which includes:

a front piece a back piece a bottom piece, a first end of which is connected to said front piece and a second end of which is connected to said back piece to form a generally U-shaped structure, said front piece, said back piece and said bottom piece having substantially the same width, said bottom piece exhibiting a plurality of raised ridges extending transversly across said bottom piece;

a pair of rack support rails connected to said front piece and to said back piece; said pair of rack support rails co-extending along side one another in a spaced parallel relation, wherein at least one of said rails includes a raised continuous spiral ridge surface thereon;

means for connecting said rack to the display stand; and at least one abrasive generally circular disc disposed in said display rack.

* * * * *